United States Patent [19]

Lubberts et al.

[11] Patent Number: 4,699,500

[45] Date of Patent: Oct. 13, 1987

[54] ELECTROGRAPHIC COPIER WITH THREE DEVELOPMENT STATIONS

[75] Inventors: Cor Lubberts, Webster; Gregory N. Stafford, Holley, both of N.Y.

[73] Assignee: Eastman Kodak Company, Rochester, N.Y.

[21] Appl. No.: 931,472

[22] Filed: Nov. 17, 1986

[51] Int. Cl.[4] ..... G03G 15/00

[52] U.S. Cl. ..... 355/4; 355/3 TR; 355/14 TR

[58] Field of Search ..... 355/3 TE, 3 TR, 4, 14 D, 355/14 TR

[56] References Cited

U.S. PATENT DOCUMENTS

| | | | |
|---|---|---|---|
| 3,743,407 | 7/1973 | Smith | 355/10 |
| 4,096,826 | 6/1978 | Stange | 118/656 |
| 4,251,154 | 2/1981 | Russel | 355/4 |
| 4,299,902 | 11/1981 | Soma et al. | 430/125 |
| 4,369,732 | 1/1983 | Jackson | 118/681 |
| 4,477,176 | 10/1984 | Russel | 355/4 X |
| 4,509,850 | 4/1985 | Weigl | 355/4 |
| 4,569,584 | 2/1986 | St. John et al. | 355/4 X |

*Primary Examiner*—Peter S. Wong
*Attorney, Agent, or Firm*—G. Herman Childress

[57] ABSTRACT

An electrographic apparatus has a photoconductor in the form of an endless web, and latent images are formed on one side of the web. The photoconductor is advanced along a path past three development stations at which latent electrostatic images on the web can be developed with colored developer material from the stations. The web is mounted for travel along a path spaced from the three development stations with the latent images of the photoconductor facing the development stations as the web passes the development stations. A plurality of back-up rollers positioned on the side of the web opposite from the development stations can engage the web to move the web out of its path of travel spaced from the development stations into a position relative to any single one of the development stations so that a latent image can be developed by such station. The three development stations are located with respect to each other and the web to enable two of the back-up rollers to be moved to bring the web into a position relative to only two of the development stations so that said two of the development stations simultaneously apply developer material to latent images on the photoconductor with the web continuing to be spaced from the other development station. High productivity is achieved, and operation of the development stations can be stopped fast and reliably.

4 Claims, 4 Drawing Figures

ELECTROGRAPHIC COPIER WITH THREE DEVELOPMENT STATIONS

BACKGROUND OF THE INVENTION

This invention relates to electrographic copiers having three or more development stations as used, for example, in color copiers/duplicators.

It is known from commonly assigned U.S. Pat. No. 4,477,176, issued Oct. 16, 1984 in the name of M. J. Russel to provide a color electrographic copier having a plurality of development stations for applying toners of different colors to electrostatic images formed on one side of a photoconductor in the form of a continuous web. As disclosed in that patent, the development stations are located on one side of the web and back-up rollers on the opposite side of the web selectively deflect the web into operative relationship with one or another of the development stations so that an image on the web can be developed with toner from a single station. The back-up rollers can be moved by solenoids, for example. While apparatus of this type may work satisfactorily, the rate of production of completed copy sheets may be slow due, in part, to the need for applying toner from only one station at a time. Thus when three toning stations are to be used to apply toner to three different but related images on a photoconductor it is necessary to allow a relatively long strip of the photoconductor to pass the several development stations while only one toning station is applying toner to an image in order to avoid overlapping of different colored toners onto a single image. Clearly it would be desirable to operate more than one of the development stations to apply toner to two different images on the photoconductor simultaneously in order to increase the throughput or copying rate of the apparatus.

SUMMARY OF THE INVENTION

Accordingly, it is an object of the present invention to provide apparatus for simultaneously applying toner from two development stations in an electrographic apparatus in order to increase the production rate of the apparatus.

Electrographic apparatus of the present invention has a photoconductor in the form of an endless web that is movable along a path past a series of stations at which a latent electrostatic image is formed on the photoconductor and developed for transfer to a receiver sheet. The apparatus has three development stations for applying developer material to the latent image as it moves past the development stations. The improvement of the present invention comprises means mounting the web for movement along a path spaced from the three development stations with the latent image of the photoconductor facing the development stations as the web passes the development stations. Means are provided for moving the web out of its path spaced from the development stations into a position relative to any single one of the development stations so that the latent image can be developed. Also, the moving means can move the web out of its path into a position relative to only two of the development stations so that two of the development stations can simultaneously apply developer material to latent images on the photoconductor.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENT

Figure 1:
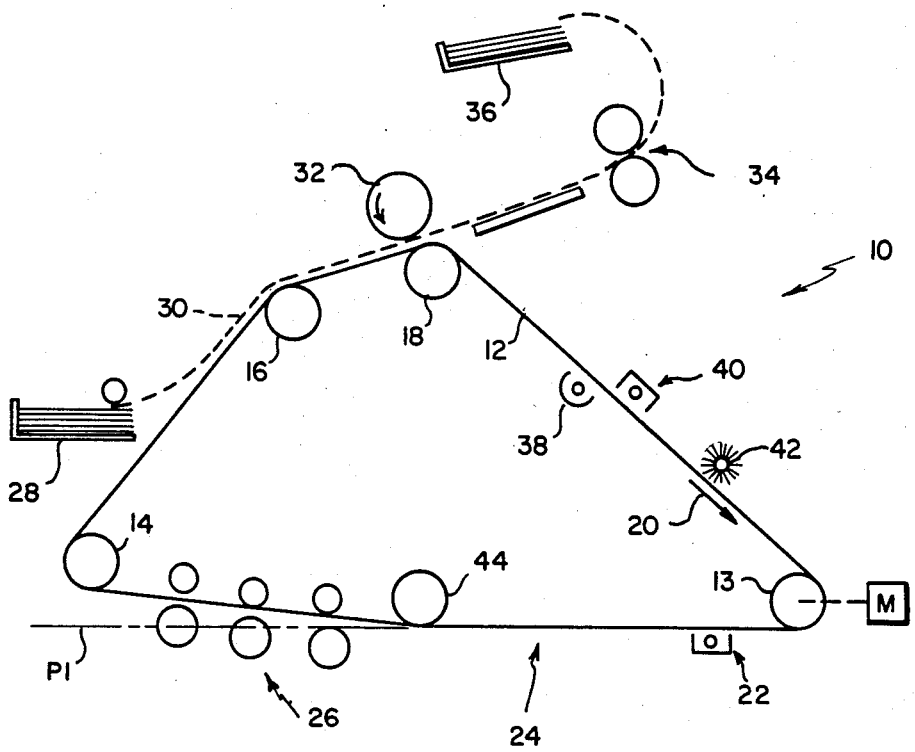
FIG. 1 is a fragmentary diagrammatic view of an electrographic copier/duplicator incorporating the apparatus of the present invention.

Referring now FIG. 1, the apparatus of the present invention can be incorporated in various types of electrographic apparatus, including a copier/duplicator as generally designated 10 in FIG. 1. The copier/duplicator 10 comprises a photoconductor 12 in the form of an endless web that is adapted to have a series of spaced latent electrostatic images formed on the outer side of the web. The web is supported by a plurality of rollers 13, 14, 16 and 18 for movement about an endless path. One of the rollers, such as roller 13 may be coupled to a motor M for driving the web in the direction indicated by arrow 20 in FIG. 1.

As the web is driven in its endless path it passes a charging station 22 at which a uniform static electric charge is applied to the photoconductive surface of the web. Then the web passes through an exposure station 24 where it is selectively discharged by a full frame flash illumination of the web, by an LED array, a laser beam, or other suitable exposure apparatus. The resulting latent electrostatic image passes through a development area generally designated 26 and described in more detail later wherein the latent image is rendered visible by applying marking particles to the latent image.

A copy sheet from a copy sheet supply 28 is moved along a dotted line path 30 and brought into registration with the developed image on the photoconductor so that the image can be transferred to the sheet. When a copy sheet is to receive developed images of two or more colors, the sheet is tacked to a roller 32 and rotated with the roller until the desired number of images are transferred to the copy sheet. The copy sheet with the developed images thereon is fed through a fuser 34 and is delivered to a receiving tray 36. The photoconductor next passes an erase lamp 38 and a cleaning assist charger 40 to loosen any development material remaining on the photoconductor. Such material is removed by a cleaning brush 42. Apparatus of the type generally described hereinbefore is known in the art and is disclosed in more detail in U.S. Pat. No. 4,477,176, for example.

Figure 2:
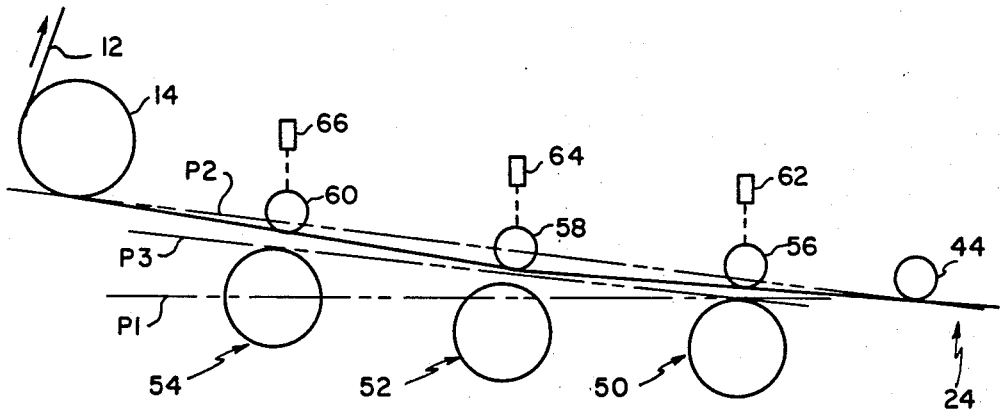
FIG. 2 is an enlarged fragmentary view of a portion of the FIG. 1 apparatus showing the relationship between three development stations and the web photoconductor when developer material is not being applied to the photoconductor.

As best shown in FIG. 2, development area 26 is located between the roller 14 for web 12 and a guide roller 44 that is located adjacent the left side of the exposure station 24 of the apparatus. Rollers 44 and 13 hold the photoconductor 12 flat in the area of the exposure station 24. The portion of the photoconductor between rollers 13 and 44 is located in a plane designated P1. Roller 14 is located above plane P1, and an imaginary plane between the bottom of rollers 14 and 44 is designated P2.

Located in the development area 26 and between rollers 44 and 14 are three development stations 50, 52 and 54. The development stations can be of any suitable construction and, for simplicity, are illustrated in the drawings as a single roller which constitutes the magnetic brush or toning roller of a magnetic brush development station. Such stations are known in the art and need not be described in more detail here. A three station system as illustrated permits the application of toners of different colors to the photoconductor. For example, the development stations 50, 52 and 54 may apply yellow, magenta and cyan toner particles, respectively, to the latent image on the bottom side of the photoconductor 12 to produce process color images. In a color copier, a fourth development station (not shown) can be provided for applying black toner particles to the photoconductor. The stations can also be used for making accent or spot color copies by applying toners that are black, brown, red, blue, etc.

In the embodiment illustrated in the drawings, the top of each of the development stations 50, 52 and 54 is located at or above plane P1 but beneath plane P2. More specifically, the top of station 50 is located at plane P1, the top of station 52 is slightly thereabove and the top of station 54 is spaced from plane P1 by a distance greater than the station 52. The top of all three stations lie not only beneath plane P2, but also beneath the path of the photoconductor 12 between the rollers 14 and 44. The stations are stepped or staggered relative to each other so that the top of station 52 is located slightly beneath a third plane P3 that passes through the top of stations 50 and 54. The importance of this relationship will be explained later.

Figure 3:
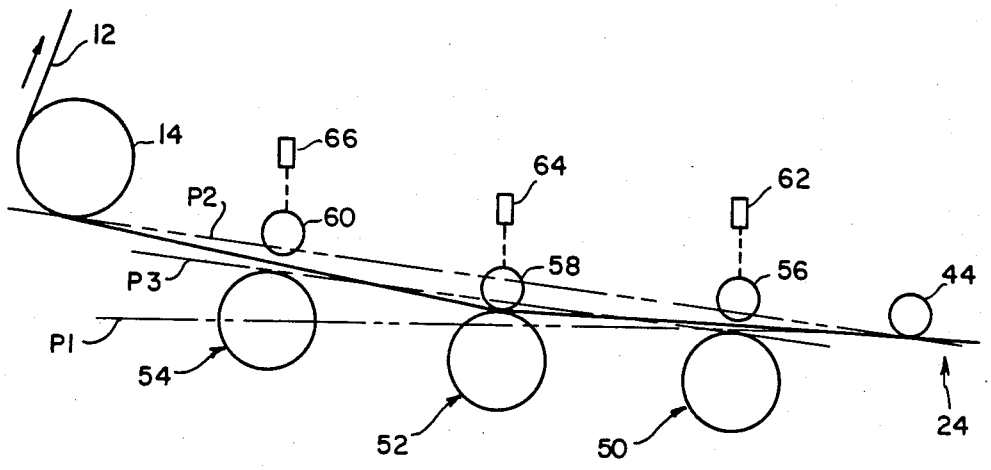
FIG. 3 is a view similar to FIG. 2 showing application of developer material from a single development station to the photoconductor.

A plurality of back-up rollers 56, 58 and 60 are located on the side of the photoconductor 12 opposite from the development stations 50, 52 and 54. Each of the back-up rollers is above one of the development stations. Rollers 56, 58 and 60 are each movable toward and away from the development station immediately therebeneath by any suitable means. As shown in the drawings, roller 56 is movable by a solenoid 62 shown diagrammatically coupled to the roller 56. Back-up rollers 58, 60 are moved by solenoids 64, 66, respectively. Other suitable means can be provided for moving the rollers, including a cam operated through a clutch mechanism at the appropriate time in the machine cycle. When the solenoids are energized by the logic and control unit of the copier/duplicator, the associated back-up roller moves toward the development station therebeneath to thereby deflect the photoconductor into a position with respect to that one station to allow developer material from the station to be transferred to a latent image on the photoconductor. Thus any one of the back-up rollers can be moved to develop latent images on the photoconductor from a single one of the development stations. This is illustrated in FIG. 3 of the drawings which shows the back-up roller 58 moved downwardly from its FIG. 2 position to its FIG. 3 position to thereby deflect the web 12 and bring the web into a position relative to development station 52 to permit a latent image on the photoconductor to be developed from the station 52. It will be observed that fixed rollers 44, 14 and movable roller 58 locate the photoconductor 12 so that it is spaced from the development stations 50 and 54 and thus prevent application of developer material from these stations to the photoconductor. In a similar manner, only station 50 or only station 54 can be used for developing images on the photoconductor.

Figure 4:
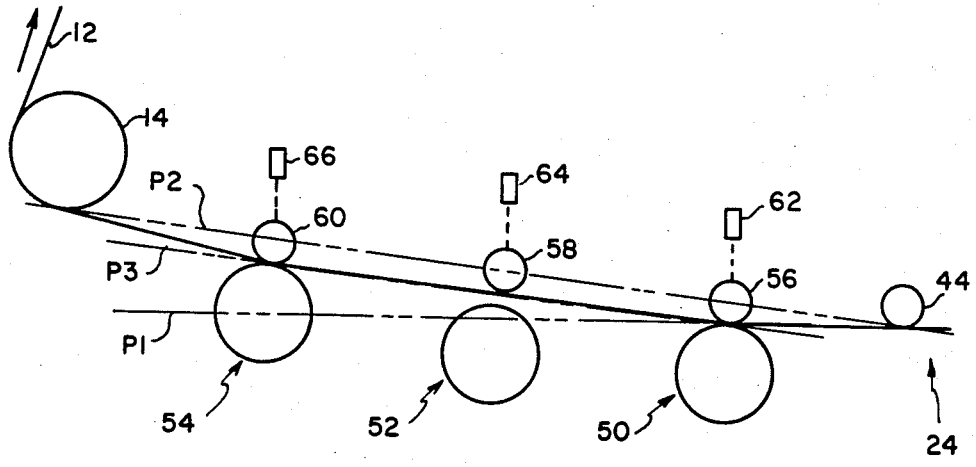
FIG. 4 is a view similar to FIGS. 2 and 3 but showing the application of developer material simultaneously from the other two development

In accordance with the present invention the development stations, web and back-up rollers are located so that two of the back-up rollers can be moved to bring the web into positions relative to only two of the development stations so that such two of the development stations can simultaneously apply developer material to latent images on the photoconductor with the web continuing to be spaced from the other development station. This is best illustrated in FIG. 4 of the drawings which shows solenoids 62, 66 energized to bring the back-up rollers 56, 60 toward the respective development stations 50, 54 so that developer material from these two stations can simultaneously be applied to latent images on the photoconductor. This locates the portion of the photoconductor between stations 50, 54 in plane P3. The spacing between these two development stations is such that they will simultaneously tone different latent images formed on the photoconductor at imaging station 24, and that such images will be transferred to one or more receiver sheets. At this time the photoconductor 12 continues to be spaced from development station 52 because that station is located beneath the plane P3 passing through the top of the development stations 50, 54.

Because the top of stations 50, 52 and 54 are located at plane P1 or above that plane, the portion of the photoconductor between rollers 44 and 14 is never moved below plane P1 and thus the photoconductor remains properly positioned in plane P1 in the exposure station 24. The staggered relationship of the development stations permits toner to be applied from only the two end stations to the photoconductor when the photoconductor is in plane P3, as shown in FIG. 4, thus permitting two images to be developed simultaneously. Also, movement of the back-up rollers, instead of the heavier development stations, simplifies the apparatus and reduces the cost of manufacture. In addition, the apparatus of the invention can stop and start the application of developer material from any station fast and reliably.

The apparatus of the present invention can significantly increase productivity of the copier/duplicator by being able to simultaneously apply toner from two of the development stations to latent images on the photoconductor. This eliminates the need to sequentially operate each of the stations individually in order to tone three different images on the photoconductor. Thus the photoconductor can be exposed with images at a more rapid rate or, alternatively, images can be placed closer together on the photoconductor. In either event, the result is improved productivity.

While the invention has been described in connection with a preferred embodiment thereof, it will be understood that variations and modifications can be effected within the spirit and scope of the invention as described hereinabove and as defined in the appended claims.

We claim:

1. In electrographic apparatus having a photoconductor in the form of an endless web and movable along a path past a series of stations at which a latent electrostatic image is formed on the photoconductor and developed for transfer to a receiver sheet, the apparatus having three development stations for applying developer material to the latent image as it moves past the development stations, the improvement comprising:

means mounting the web for movement along a path spaced from the three development stations with the latent image of the photoconductor facing the development stations as the web passes the development stations, means for moving the web out of its path spaced from the development stations (1) into a position relative to any single one of the development stations so that the latent image can be developed and (2) into a position relative to only two of the development stations so that two of the development stations can simultaneously apply developer material to latent images on the photoconductor.

2. The invention as set forth in claim 1 wherein the web has first and second sides and the photoconductor is on the first side of the web, and the moving means comprises three rollers engageable with the second side of the web and moveable independently toward and away from the development stations for bringing the photoconductor into a position relative to the development stations for receiving developer material from one or more of the stations.

3. In electrographic apparatus having a photoconductor in the form of an endless web adapted to have latent images formed on one side of the web, means for advancing the photoconductor along a path past three development stations at which latent electrostatic images on the web can be developed with developer material from the stations, the improvement comprising:

means mounting the web for travel along a path spaced from the three development stations with the latent image of the photoconductor facing the development stations as the web passes the development stations, a plurality of back-up rollers positioned on the side of the web opposite from the development stations, each of the rollers being engageable with the web to move the web out of its path of travel spaced from the development stations into a position relative to any single one of the development stations so that a latent image can be developed by such station, the three development stations being located with respect to each other and the web so that two of the back-up rollers can be moved to bring the web into a position relative to only two of the development stations so that said two of the development stations can simultaneously supply developer material to latent images on the photoconductor with the web continuing to be spaced from the third one of the development stations.

4. The invention as set forth in claim 3 wherein the development stations are spaced from each other with said two stations being at opposite sides of said third station, and said third station being offset from plane through the top of said two stations.

* * * * *